US008771099B2

(12) United States Patent
Hartline

(10) Patent No.: US 8,771,099 B2
(45) Date of Patent: Jul. 8, 2014

(54) MESH GOLF TEE

(76) Inventor: John M. Hartline, Sandy, UT (US)

( * ) Notice: Subject to any disclaimer, the term of this patent is extended or adjusted under 35 U.S.C. 154(b) by 0 days.

(21) Appl. No.: 12/549,185

(22) Filed: Aug. 27, 2009

(65) Prior Publication Data

US 2011/0053710 A1 Mar. 3, 2011

(51) Int. Cl.
*A63B 57/00* (2006.01)

(52) U.S. Cl.
USPC ..... 473/287; 473/396; 473/401

(58) Field of Classification Search
USPC ..... 473/387–403, 301
See application file for complete search history.

(56) References Cited

U.S. PATENT DOCUMENTS

| | | | | | |
|---|---|---|---|---|---|
| 638,920 | A * | 12/1899 | Grant | ..... | 473/396 |
| 1,858,800 | A * | 5/1932 | Boatman | ..... | 473/401 |
| 2,531,470 | A * | 11/1950 | Rickard | ..... | 473/396 |
| 3,414,268 | A * | 12/1968 | Chase | ..... | 473/396 |
| 4,976,431 | A * | 12/1990 | Guenther | ..... | 473/417 |
| 5,569,102 | A * | 10/1996 | Karron | ..... | 473/401 |
| 6,200,233 | B1 * | 3/2001 | Moody | ..... | 473/398 |
| 6,361,450 | B1 * | 3/2002 | Huang | ..... | 473/300 |
| 7,901,303 | B2 * | 3/2011 | Toyosawa | ..... | 473/387 |
| 2002/0052248 | A1 * | 5/2002 | Chen | ..... | 473/301 |
| 2004/0259661 | A1 * | 12/2004 | Chen | ..... | 473/301 |
| 2007/0249433 | A1 * | 10/2007 | DeSmit | ..... | 473/397 |
| 2011/0275450 | A1 * | 11/2011 | Ou et al. | ..... | 473/301 |

FOREIGN PATENT DOCUMENTS

| | | | | | |
|---|---|---|---|---|---|
| GB | 2258161 | A * | 2/1993 | ..... | A63B 57/00 |

* cited by examiner

*Primary Examiner* — Steven Wong
(74) *Attorney, Agent, or Firm* — Brian Tucker; Kirton McConkie

(57) ABSTRACT

Embodiments of a mesh golf tee are disclosed having a shaft and an upper mesh portion for supporting a golf ball. The upper mesh portion may provide less resistance to a club to allow greater power applied to the ball. The mesh portion may also flex such that the ball is not deflected by any portion of the tee upon impact by a golf club, allowing for greater consistency.

11 Claims, 3 Drawing Sheets

MESH GOLF TEE

FIELD

This disclosed devices and methods of use are related to golf equipment. More particularly, embodiments of a golf tee with mesh components to limit loss of energy and control due to launch of a golf ball from a conventional tee.

BACKGROUND

Golf is a multi-billion dollar business in the United States. Millions of people play golf each year on thousands of courses, driving ranges, and other locations. Hundreds of millions of balls are made and used each year, and some estimate that billions of wooden tees are used in the US each year.

Traditional golf tees are made from wood or plastic with a very small cup portion on one end for holding a golf ball above the ground for a better strike with a golf club. Teeing up a ball allows for better control and distance than playing off of the ground. The small cup portion on traditional tees makes it difficult at times to balance the ball on the cup. The cup is made as small as practicable to limit the effect of the tee on the shot as the ball is struck.

Because the ball rests in the cup portion of the tee, some of the energy is transferred to the cup of the tee as the ball moves with respect to the tee after being struck by a club. Evidence of the energy imparted to tees is easily visible by inspecting used tees. Often, used tees have a broken cup portion, with an edge of the cup being split away from the tee, rendering the tee useless as it will no longer support a ball. Additionally, the sole of the clubhead often shows evidence of lost energy from paint or plastic from the tee transferred onto the clubhead. This transferred energy can reduce the amount of energy imparted to the ball, costing the golfer distance and control.

Similarly, with the ball having to move out of the cup portion of the tee when struck, the cup can slightly alter the flight of the ball in an inconsistent manner, such as with different rotation or action off of the clubhead than without the tee, adding some inconsistency to an already difficult game that rewards consistency.

Some solutions to these problems have been proposed by using a tee with prongs holding the ball instead of a cup. However, this tee is difficult to use as the ball is even more difficult to balance on such tees. Similarly, a brush tee has been used to reduce the energy lost with a traditional tee. Brush tees have a disadvantage of not appearing like a tee, and being large and bulky. Additionally, brush tees tend to be expensive and the bristles can become trained in undesirable ways when frequently used or when stored in golf bags.

What is needed is a golf tee that supports the ball well and provides minimal resistance to a club stroke, while having durability and maintaining form and usefulness.

SUMMARY

Embodiments of golf tees are disclosed. Exemplary mesh golf tees may include a solid shaft made from plastic, wood, metal, or other material and an upper mesh portion forming a cup for holding a golf ball when teeing up the ball in preparation for hitting the ball. The upper mesh portion may be affixed to the shaft to make the tee reusable. The mesh portion of the tee may flex when the ball is struck such that very little energy is imparted into the golf tee from the club or the ball, thereby allowing greater energy to be imparted to the ball. Similarly, the cup may flex to allow the ball to take the trajectory intended by the club when striking the ball without having to leave the rigid cup of a conventional tee, providing greater consistency.

The cup portion may be formed from woven mesh tubing, which may be partially inverted to give greater strength to the tubing. The inverted portion may then be doubled over to form the cup for holding a golf ball. The cup may be glued, welded, or otherwise permanently affixed to the shaft. In some embodiments, the tubing may be sealed on the edges to prevent fraying. The cup portion may also be formed by simply expanding one end of the tubing to provide a cup-like portion for supporting a golf ball.

BRIEF DESCRIPTION OF THE DRAWINGS

The following description can be better understood in light of Figures, in which.

Figure 1:
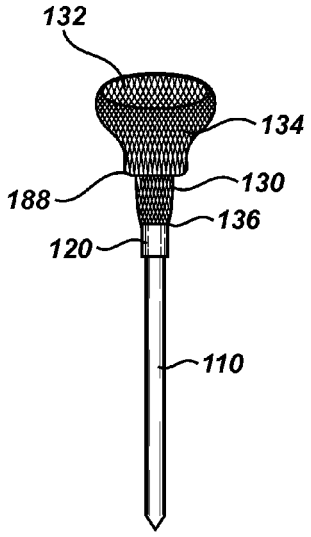
FIG. 1 illustrates an embodiment of a mesh golf tee.
Figure 2A:
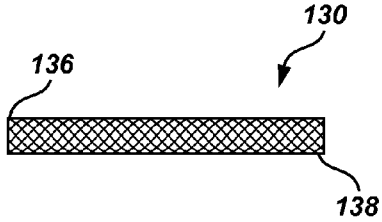
FIGS. 2*a*-2*d* illustrate a process of preparing a mesh golf tee.
Figure 2B:
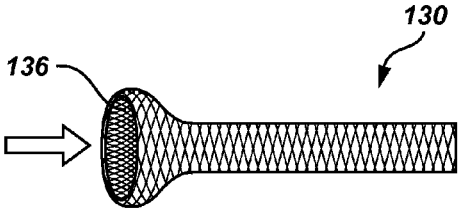
Figure 2C:
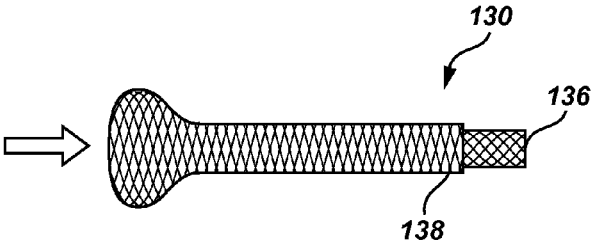
Figure 2D:
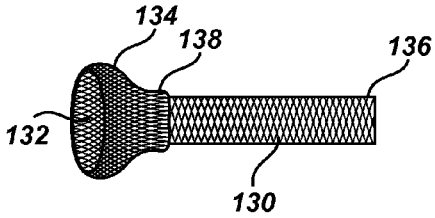

Together with the following description, the Figures demonstrate and explain the principles of exemplary embodiments of mesh golf tees. In the Figures, the thickness, size, dimension, and configuration of components may be exaggerated for clarity. The same reference numerals in different Figures represent the same component.

DETAILED DESCRIPTION

Aspects and features of mesh golf tees are disclosed and described below. Each of the tees described below provide a mesh top that is strong enough to support a ball in a teed position, while offering minimal resistance to a swinging club, thereby allowing the energy that is usually consumed by a traditional tee to be imparted to the ball. Similarly, the mesh top portion may reduce any ball movement due to the ball being obstructed by a portion of the tee as can occur using a traditional tee.

FIG. 1 illustrates tee 100 with shaft 110, interface 120, and mesh top 130. Shaft 110 may be any suitable material and length, as desired. For example, shaft 110 may be made of plastic, wood, metal, biopolymer, or other material, and may have an overall length such that the overall height of tee 100 corresponds to the available lengths of conventional golf tees, between about 2 and 6 inches, with PGA approved tees not exceeding 4 inches. Shaft 110 may be constructed such that it will penetrate surfaces used for golfing, particularly in tee box.

Interface 120 connects shaft 110 to mesh top 130. Interface 120 may be shrink tubing, glue, adhesive, a welded portion, plastic tubing, etc, such that shaft 110 is permanently affixed to mesh top 130. For example, interface 120 may be a fused portion of shaft 110 and mesh top 130 fused by sonic welding. Similarly, interface 120 may be adhesive covered with a plastic tubing for strength such that shaft 110, interface 120, and mesh top 130 are all affixed together with the adhesive.

In some embodiments, the portion of shaft 110 corresponding to interface 120 may have a smaller cross-sectional area than the main portion of shaft 110 to allow for a generally streamline transition between shaft 110, interface 120 and mesh top 130. In other embodiments, the interface portion of shaft 110 may have various profiles, such as a narrow notch with a larger end such that a portion of mesh top 130 can be constricted at interface 120 and the notch and also be limited from separating from shaft 110 because of an increased cross-sectional area. Similarly, in some embodiments, the shaft may have a cupped top to assist with the insertion to the ground through use of the golf ball providing force for ground insertion.

Mesh top 130 may be formed from woven mesh tubing and may include cup 132, doubled portion 134, connection end 136, and edge 138. The woven mesh tubing may be woven such that pulling on the mesh tubing forces the cross-sectional diameter of the tubing to decrease, and causing the tubing to constrict around any object within the mesh tubing. Such tubing has been used with wiring applications. Normally, such tubing expands when compressed axially, opposite of the constricting motion when pulling.

FIGS. 2*a*-2*d* illustrate embodiments of steps to create mesh top 130 from a section of woven mesh tubing. A section of tubing may be formed by cutting a predetermined length of tubing from a roll of tubing using any cutter. In some embodiments, a heat knife may be used to fused the weaved threads in the woven mesh tubing to prevent fraying of the tubing at edge 138 and connection end 136.

In the figures, connection end 136 is forced back through the center of mesh top 130 and extended until only the outside of doubled portion 134 is in the original orientation, with the remainder of mesh top 130 having been inverted. Once complete, cup 132 is thereby formed around doubled portion 134, and connection end 136 is ready to be connected to shaft 110 at interface 120. By inverting the woven mesh tubing, the tubing still constricts when pulled, but it also tends to constrict when compressed axially as well, as the weaving pushes the tubing towards the center. This compression allows a golf ball to rest within 132 without mesh top 130 shortening significantly, while maintaining strength to support the ball.

In some embodiments, connection end 136 may be pulled outside rather than inside such that edge 138 ends up disposed within cup 132 rather than outside as shown. In other embodiments woven mesh tubing may be formed such that it is not necessary to pull connection end 136 all of the way through to achieve the compression characteristics described above, but rather may allow end 138 to be rolled over to form doubled portion 134 and cup 132.

Figure 3:
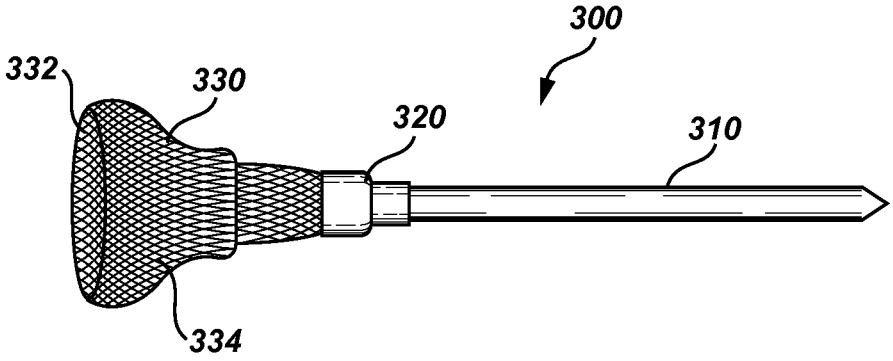
FIG. 3 illustrates an embodiment of a mesh golf tee.

FIG. 3 illustrates tee 300 with shaft 310, interface 320, and mesh top 330. Tee 300 may include a larger diameter mesh top 330 than mesh top 130 of previously described embodiments. The larger diameter may allow for easier use by certain individuals such as children, beginners, and seniors as cup 332 is thereby made larger and the general strength of mesh top 332 may be somewhat greater along with double portion 334.

Figure 4:
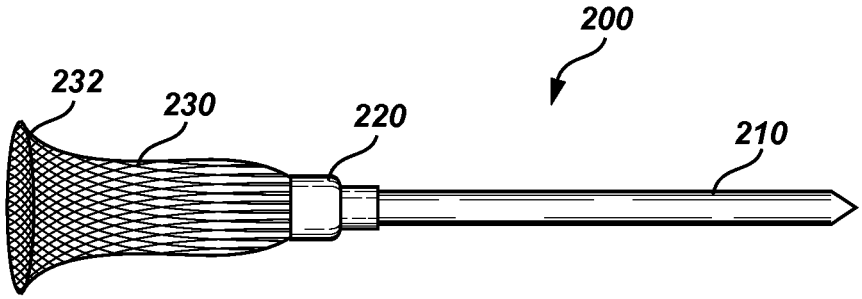
FIG. 4 illustrates an embodiment of a mesh golf tee.

In some embodiments, a doubled portion may be omitted, such as is shown in FIG. 4, which illustrates tee 200 with shaft 210, interface 220, and mesh top 230. Cup 232 may be formed by flaring the tubing of mesh top 230 and sealing the edges to prevent movement. The embodiment of FIG. 4 may allow a higher amount of the club energy to be imparted to the ball, as it will yield more easily to the club without the doubled portion.

Figure 5:
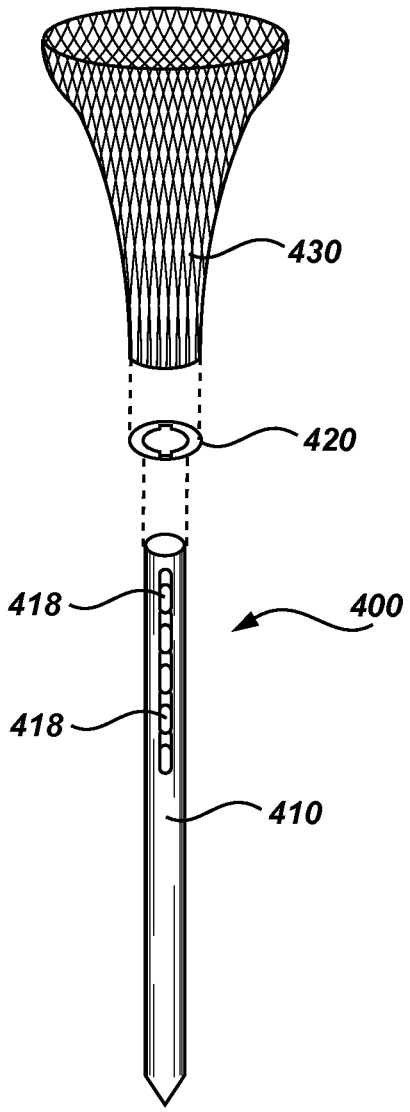
FIG. 5 illustrates an embodiment of a modular mesh golf tee.

As shown in FIG. 5, some embodiments may include a height-adjustable mesh top 430 being adjustably connected to shaft 410. Interface 420 may be shaped such that it may be secured by flanges 418 on shaft 410. Mesh top 430 may be rotated with respect to shaft 418 until it may be moved up and down on shaft 418, allowing a user to select a height, at which point mesh top 430 may be rotated, securing mesh top 430 in a desired location and there by adjusting the overall height of tee 400. In such embodiments, the overall height of tee 400 may be adjusted 1" or more.

Each of the disclosed tees may be made in any desirable color. In some embodiments, the ratio of shaft 110 to mesh top 130 may be adjusted as desired. For example, mesh top 130 may be generally only cup 132 with doubled portion 134 extending over interface 120, or mesh top 130 may be over half of the total length of tee 100. Generally, the longer mesh top 130, the less resistance to the club when striking a ball supported by tee 100.

Each feature shown and described in the various embodiments and configurations may be used on other embodiments and configurations, as desired and appropriate. The embodiments and configurations illustrated and described are exemplary of the features of the invention as defined by the appended claims. The claims are not limited by only what is described in this disclosure, as the principals and features of the invention may be incorporated in various embodiments anticipated by this disclosure.

What is claimed is:

1. A golf tee, comprising:

a rigid shaft configured to be reusably inserted into the ground;

a cup formed from a mesh tubing coupled to the shaft, wherein the cup is configured to support a golf ball, wherein at least some of the portion of mesh tubing affixed to the shaft is covered by an interface between the shaft and the portion of mesh tubing, and wherein the mesh tubing has a cross-sectional diameter similar in size to the rigid shaft where the mesh tubing is coupled to the shaft; and wherein the cup is adjustably coupled to the shaft such that the overall height of the golf tee can be changed.

2. The golf tee of claim 1, wherein the mesh tubing is substantially inverted.

3. The golf tee of claim 1, wherein the cup is formed by doubling over the mesh tubing.

4. The golf tee of claim 1, wherein the cup is formed by spreading open an end of the mesh tubing.

5. The golf tee of claim 1, wherein the shaft is plastic.

6. The golf tee of claim 1, wherein the mesh tubing is formed of woven plastic.

7. The golf tee of claim 1, wherein the cup is permanently coupled to the shaft.

8. The golf tee of claim 7, wherein the cup is coupled to the shaft using at least one of an adhesive, sonic welding, or shrink tubing.

9. The golf tee of claim 1, wherein the cup is removably coupled to the shaft.

10. The golf tee of claim 1, wherein the shaft includes an interface for coupling to the cup, the interface having a smaller diameter than the adjacent portion of the shaft.

11. A golf tee, comprising:

a solid shaft;

mesh tubing having a cup portion and a connector portion;

an interface material coupling the connector portion to the shaft, the golf tee having the general shape of a conventional golf tee, wherein at least some of the portion of mesh tubing affixed to the shaft is covered by an interface between the shaft and the portion of mesh tubing; and wherein the cup is adjustably coupled to the shaft such that the overall height of the golf tee can be changed.

* * * * *